US006296354B1

(12) United States Patent
Hashimoto

(10) Patent No.: US 6,296,354 B1
(45) **Date of Patent: *Oct. 2, 2001**

(54) INK CONTAINER WITH PLURAL INK CHAMBERS EMPTIED SEQUENTIALLY, AND RECORDING APPARATUS HAVING THE SAME

(75) Inventor: Kenichirou Hashimoto, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/969,836

(22) Filed: Nov. 13, 1997

Related U.S. Application Data

(63) Continuation of application No. 08/338,169, filed on Nov. 9, 1994, now abandoned.

(30) Foreign Application Priority Data

Nov. 9, 1993 (JP) ..... 5-279365

(51) Int. Cl.[7] ..... B41J 2/175
(52) U.S. Cl. ..... 347/87
(58) Field of Search ..... 347/86, 87, 7, 347/85; 73/290 R, 323

(56) References Cited

U.S. PATENT DOCUMENTS

| | | | | |
|---|---|---|---|---|
| 4,313,124 | | 1/1982 | Hara . | |
| 4,345,262 | | 8/1982 | Shirato et al. . | |
| 4,459,600 | | 7/1984 | Sato et al. . | |
| 4,463,359 | | 7/1984 | Ayata et al. . | |
| 4,558,333 | | 12/1985 | Sugitani et al. . | |
| 4,723,129 | | 2/1988 | Endo et al. . | |
| 4,740,796 | | 4/1988 | Endo et al. . | |
| 5,430,471 | * | 7/1995 | Nakajima et al. | 347/87 |
| 5,621,446 | * | 4/1997 | Tanaka et al. | 347/85 |

FOREIGN PATENT DOCUMENTS

| | | | | |
|---|---|---|---|---|
| 488 829 | * | 6/1992 | (EP) | 347/7 |
| 54133733 | | 9/1979 | (JP) . | |
| 117465 | | 6/1982 | (JP) . | |
| 59123670 | | 7/1984 | (JP) . | |
| 59138461 | | 8/1984 | (JP) . | |
| 59194853 | | 11/1984 | (JP) . | |
| 61-35892 | * | 3/1986 | (JP) . | |
| 63-252747 | * | 10/1988 | (JP) | 347/7 |
| 64-35215 | * | 6/1989 | (JP) . | |

* cited by examiner

*Primary Examiner*—Judy Nguyen
(74) *Attorney, Agent, or Firm*—Fitzpatrick, Cella, Harper & Scinto

(57) ABSTRACT

An ink container includes at least one partition dividing the container into plural ink chambers connected in series through an ink path in each the partition; an air vent for communicating a first ink chamber with the atmosphere and an ink supply port for supplying ink from a second ink chamber; wherein the ink path in each the partition provides for an ink flow to the supply port that empties each the chamber in the series in turn as ink is supplied from the supply port; wherein the second ink chamber has a volume smaller than another ink chamber.

23 Claims, 9 Drawing Sheets

INK CONTAINER WITH PLURAL INK CHAMBERS EMPTIED SEQUENTIALLY, AND RECORDING APPARATUS HAVING THE SAME

This application is a continuation of application Ser. No. 08/338,169 filed Nov. 9, 1994 now abandoned.

FIELD OF THE INVENTION AND RELATED ART

The present invention relates to a liquid container for containing liquid, more particularly to an ink container for containing ink usable for recording and an ink jet recording apparatus.

In a recording apparatus such as a printer, copying machine or facsimile machine or a recording apparatus used as an output apparatus for a combined electronics apparatus or work station including a computer, word processor or the like, an image is recorded on a recording material such as a sheet of paper or a plastic thin film in accordance with image information. The recording apparatus is classified into a ink jet type, a wire dot type, a thermal type and a laser beam type depending on the recording system.

A recording apparatus of an ink jet type is such that a droplet of ink are ejected from a recording head onto a recording material. This type has the following advantages:

1. The size of the recording means can be easily reduced, and a high resolution image can be recorded at a high speed.
2. The recording is possible on plain paper, and the running cost is low because the ink is consumed in accordance with the information to be recorded.
3. The recording is a non-impact type without contact to the recording material, and therefore, the noise is low.
4. Color image formation is easy by using multi-color inks.

As the means for ejecting the ink, thermal energy generating means such as sheet generating element is known. The type in which the ink is ejected using thermal energy is called "bubble jet", and is advantageous over the piezoelectric type in the high density and high speed recording.

The recording head for the ink jet type using the thermal energy can be formed through semiconductor manufacturing process including etching, evaporation, sputtering or the like to construct electrothermal transducers, electrodes, passage walls and top plate. Therefore, liquid passages (ejection outlets) at a high density, can be easily manufactured, so that further downsizing is possible.

In an ink jet recording system, an ink container for containing ink to be supplied to the recording head is fixed at a predetermined position in an ink jet recording apparatus in one system, and the ink container is mounted on a carriage together with a recording head in another type. In the former type, an ink supply passage in the form of an ink tube or the like is provided between the recording head and the ink container to follow movement of the carriage. In the latter type, the ink supply passage between the recording head and the container is relatively short. Therefore, the type having the ink container on the carriage is suitable for the downsizing and the simplification of the ink jet recording apparatus, Among the structures in which the recording head and the ink container are both carried on a carriage, the recording head and the ink container are integrally formed in one type, and the recording head and the ink container are separable in another type.

In the type in which the recording head and the ink container are integral with each other, the cartridge constituted by the ink container and the recording head is replaced with a new cartridge when the ink in the ink container is used up, and therefore. the handling is easy. For this reason, this type is widely used recently. However, the relatively expensive recording head has to be exchanged whenever the ink in the ink container is used up, the running cost increases.

In the type in which the recording head and the ink container are separable, only the ink container containing the ink is exchanged when the ink is used up, and therefore, the recording head may be exchanged only when the service life of the recording head ends.

In the normal use, the service life of the recording head is not shorter than the period in which the ink in ink container is used up. For this reason, the number of exchanges of the expensive recording heads is smaller than that of the ink container, thus reducing the running cost. However, in the case of the separable recording head and the ink container, the connecting portion between the ink container and the recording head is required to have such a structure as to prevent ink leakage.

In a recording apparatus using an ink jet type, it is desired that the ink is properly supplied in accordance with ejections of the ink through the recording head by the recording operation and that the ink does not leak out through the ejection outlets during the recording operation.

The ink leakage through the ejection outlet is a problem peculiar to the ink jet recording. In order to solve this problem, the pressure at the ejection outlets is maintained at a lower level than the ambient pressure. In order to provide such a pressure, the ink supply system is provided With a vacuum producing mechanism. Here, the vacuum means a back pressure against the ink supply to the ejection outlet and particularly means the pressure lower than the ambient pressure.

When the ink container is a replaceable type, it is further desired in addition to the above that the ink container can be easily mounted or demounted without ink leakage and that the ink can be supplied to the recording head with certainty.

In any of the above-described various ink jet recording apparatuses, it is desired that the ink containing means is replaced at proper timing, and therefore, it is desired that the quantity of the ink remaining in the ink container is correctly detected and/or that the ink empty timing is properly detected.

When the ink in the ink container is used up during a recording operation, ink ejecting means is operated to produce ejection energy with non-existence of the ink. In an ink jet recording apparatus in which the ink is ejected using pressure produced by state change of the ink caused by the heat, the temperature of the recording head is unnecessarily increased if the thermal energy generating means is actuated without the ink, and therefore, the recording head itself may be damaged.

In an ink jet recording apparatus in which mechanical pressure generating means such as piezoelectric element or the like as the ejection means, the pressure continues to be produced without load for ink ejection, so that the ejection means is deteriorated, thus reducing the durability.

As for the means for detecting ink container empty, Japanese Laid-Open Patent Application No. 133733/1979 discloses detecting the transparency of the ink container using an optical element, and Japanese Patent Application Publication No. 17465/1989 discloses electrodes, and Japanese Laid-Open Patent Application No. 194853/1984 discloses counting the number of ejection pulses to predict the used amount of the ink (dot count type).

In an ink jet recording apparatus it is preferable in order to stably eject the ink through the recording head and to prevent leakage of the ink through the ejection outlet during the stand-by period that the ink at the ejection outlet is maintained always at proper vacuum condition. In the conventional ink jet recording apparatus, as a means for realizing the vacuum state, a level of the ink in the container is maintained at a level lower than that of the recording head at all times. In such an ink jet recording apparatus, the gravity is used, and therefore, the position or pose of the apparatus has to be fixed during use.

In such an ink jet recording apparatus, the detection of the remaining amount of the ink is relatively easy. It may be detected by using float to detect the level of the ink in the container, or a plurality of electrodes may be disposed so as to be exposed above the liquid level at a certain liquid level, and the impedance change between the electrode is detected.

However, small size or portable ink jet recording apparatus is desired recently, in which the ink container is desired to be mounted on the recording apparatus, as contrasted to the prior apparatus wherein the ink container is mounted in the apparatus away from the carriage. As an ink container in which proper negative pressure is produced for the recording head and ink which the ink does not leak through the ejection outlet during non-recording, has been proposed in U.S. Ser. Nos. 934,327 and 974,706.

Referring to FIG. 9, there is shown a part of such an ink container, and FIG. 10 is a sectional view of the ink container of FIG. 9. The ink container is shown as being in connection with a recording head 105 for ejecting the ink As shown in FIGS. 9 and 10, the body of the conventional ink container is provided with a porous material plate 103 of sponge or the like on the bottom wall 101*a*. The container 101 is divided into six chambers by five partition plates 102*a*–102*e* except for the portions of the porous material 103. The material of the container may be substantially transparent, so that the remaining amount of the ink can be known.

At the outside surface of the front wall 101*b* of the body of the container 101, a recording head 105 is mounted, and in the rear wall 101*c*, an air vent 104 is formed. The air vent opens substantially at the central portion of the associated chamber, and therefore, when the ink is in the chamber having the air vent 104, the ink does not leaks out through the air vent irrespective of the position or pose of the ink container, provided that the quantity of the ink is lower than one half of the volume of the chamber.

Referring to FIG. 11, the operation of the ink container shown in FIGS. 9 and 10 during the recording operation will be described.

During the recording operation, it is desirable in order to stably supplied ink that at least a part of the porous material 103 is disposed at the bottom of the ink container, as shown in FIG. 11A.

At the initial stage, the ink container is filled with the ink in all of the chambers except for the first chamber with the air vent 104. With the printing operation, as shown in FIG. 11A, the ink is consumed from the chamber remotest from the ejection outlets 105*a*. As shown in FIGS. 9 and 10, the means for detecting the remaining amount of the ink is disclosed in U.S. Ser. No. 08/189,848.

The ink container shown in FIGS. 9 and 10 involves the following two problems.

As a first problem, the reduction of the remaining amount of the ink in the chamber with consumption of the ink occurs for the respective chambers, and therefore, the ink remaining amount can be approximately detected, but the detection accuracy is not high because the change of the ink level is slow. For example, an ink cartridge capable of containing an amount of ink for 200 page printing of 1500 character/A4, is required to have the ink capacity of approx. 10 cc. When the cartridge is divided into 5 chambers, the dimensions of the one chamber is approx. 10 in the longitudinal direction, approx. 14 mm in the lateral direction and approx. 14 mm in the height, for example. The reduction of the ink level per 1 page is 0.35 mm. Such a change is not large enough to be detected by the eyes of the operator. Even if a photosensor is used for the detection of the change of the liquid level, it is still difficult because the detection accuracy of a reflection type photosensor, for example, is ±1 mm approximately, and therefore, the error of the detection is as large as ±3 page.

Therefore, the correct ink remaining amount detection is difficult. Before the ink in the ink cartridge is used up, it is necessary to notify the short of the ink, and therefore, the shortness of the ink has to be notified with a relatively large quantity of the ink remains, because of the poor detection accuracy.

Another problem is that when the ink has been consumed to the extent of the ink chamber having the ink supply port, the ink supply port is exposed above the ink liquid chamber if the cartridge is upside down. If this occurs, the air is introduced through the supply port with the possible result of ejection failure during the printing operation.

SUMMARY OF THE INVENTION

Accordingly, it is a principal object of the present invention to provide an ink container and an ink jet recording apparatus in which the wasteful use of the ink is minimized.

It is another object of the present invention to provide an ink container and an ink jet recording apparatus in which a remaining quantity of the ink in an ink container having a large capacity per unit container volume is accurately detected.

According to an aspect of the present invention, there is provided an ink container comprising: at least one partition dividing the container into plural ink chambers connected in series through an ink path in the partition; an air vent for communicating a first ink chamber with the atmosphere and an ink supply port for supplying ink from a second ink chamber; wherein the ink path in each partition provides for an ink flow to the supply port that empties each chamber in the series in turn as ink is supplied from the supply port; wherein the second ink chamber has a volume smaller than another ink chamber.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the description will be made as to the preferred embodiments of the present invention.

Embodiment 1

Figure 1:
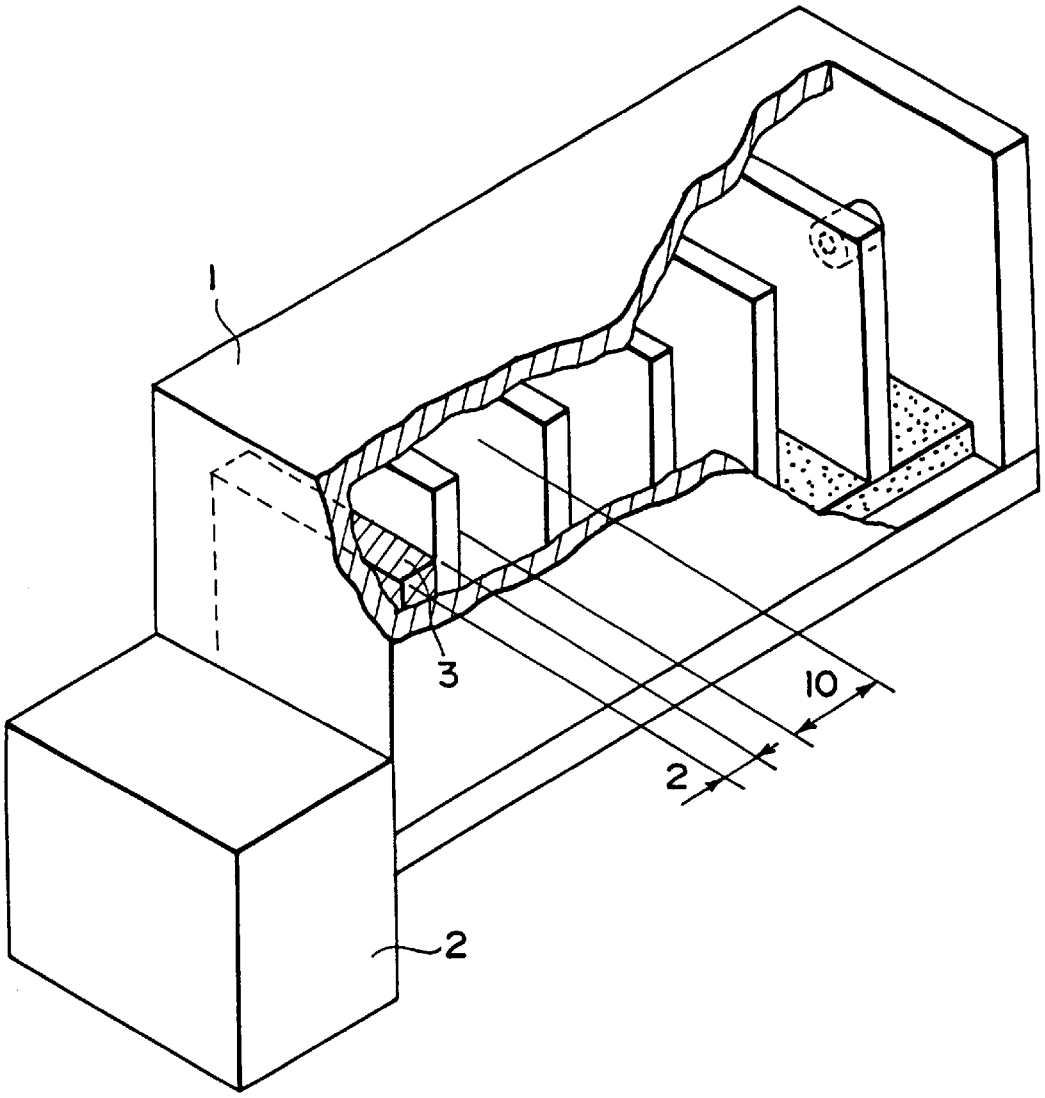
FIG. 1 is a perspective view of an ink cartridge according to an embodiment of the present invention.
Figure 2:
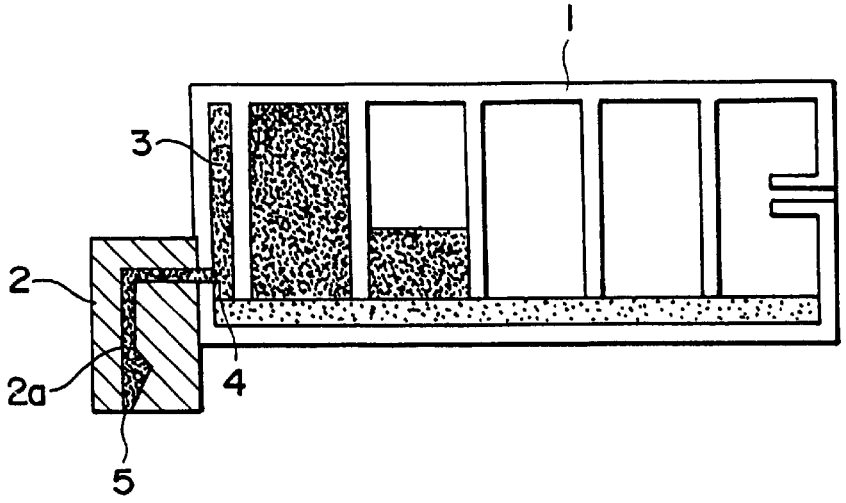
FIG. 2 is a schematic sectional view of an ink cartridge according to an embodiment of the present invention.
Figure 9:
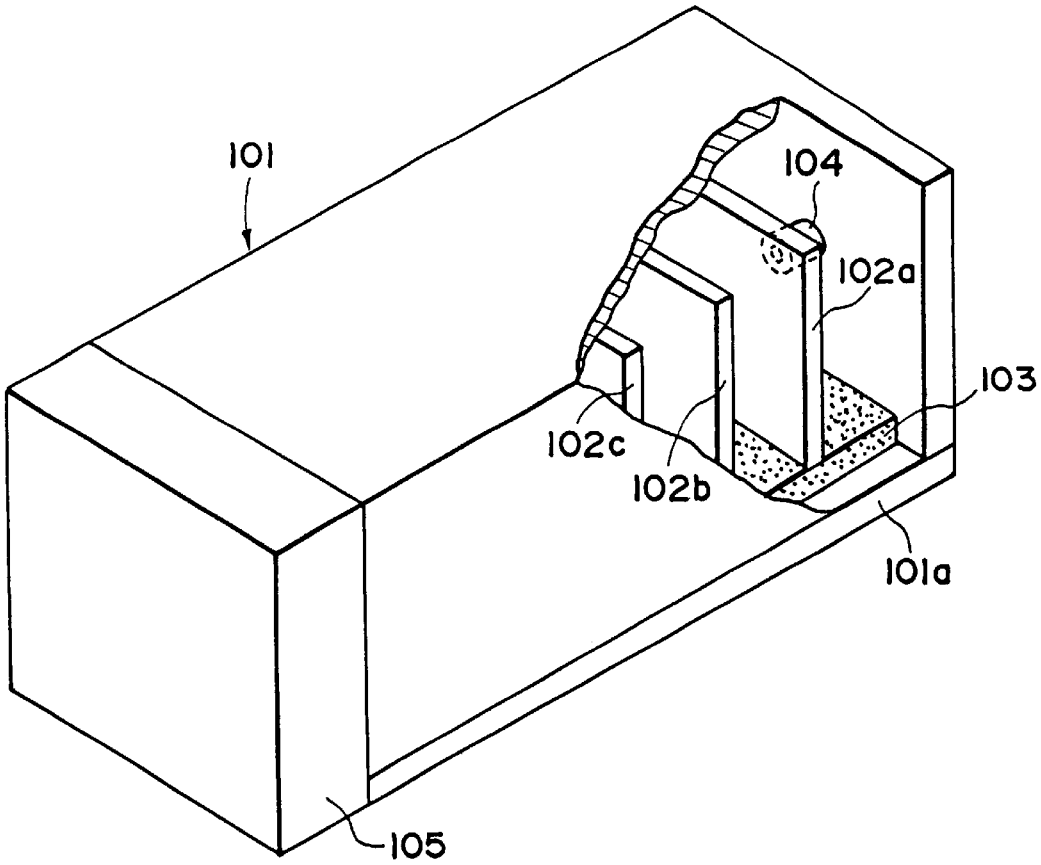
FIG. 9 is a perspective view of an ink cartridge in which a plurality of ink chambers are in fluid communication.
Figure 10:
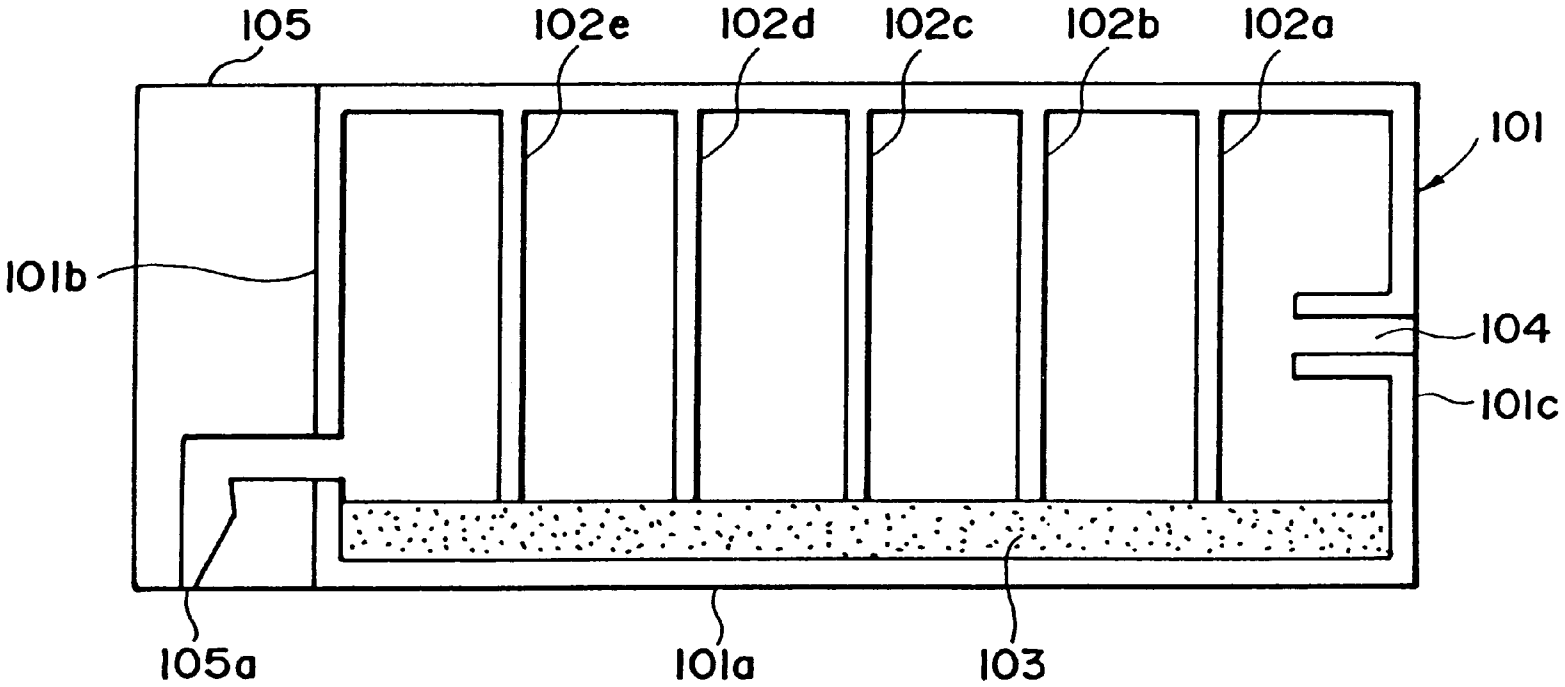
FIG. 10 is a sectional view of an ink cartridge in which a plurality of ink chambers are in fluid communication.
Figure 11A:
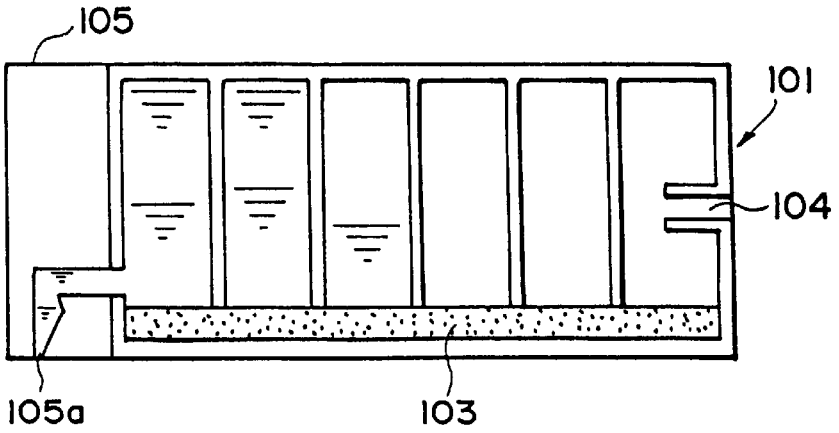
FIGS. 11*a*–11*c* are schematic views illustrating a mechanism of motions of ink and gas in an ink cartridge in which a plurality of ink chambers are in communication.

FIG. 1 is a schematic perspective view of an ink container according to an embodiment of the present invention. In FIG. 1, a part of the ink container is broken for the purpose of explanation. FIG. 2 is a schematic sectional view of the ink container. In FIGS. 1 and 2, the ink container is connected with a recording head. The recording head 2 is provided with ejection means (e.g. thermal energy converting elements 2*a*) for ejecting the ink to eject the ink to the recording material such as paper. In the examples of FIGS. 1 and 2, the ink container and recording head are connected, but this is not limiting, and the ink container and the recording head are respectively detachably mountable independently, or the ink container and recording head are connected to be an integral structure, and the integral structure are detachably mountable to the recording apparatus. Similarly to the ink container shown in FIGS. 9 and 10, the ink container of FIGS. 1 and 2 is such that the ink is consumed from the remotest ink chamber from the recording head 2. The ink consumption process will be described in the example of ink container shown in FIGS. 9 and 10. In FIGS. 9–11, the plurality of ink chambers are called first ink chamber, second ink chamber, etc., beginning with; the remotest chamber from the ejection outlet 105*a*. In the embodiment shown in FIGS 9–11, there are a total of six ink chambers, so that the sixth chamber is closest to the ejection outlet 105*a*, the fifth chamber is adjacent to the sixth chamber on the air vent 104 side, and so on.

With the consumption of the ink through the ejection outlet 105*a*, the ink in the sixth chamber closest to the ejection outlet 105*a* is reduced by an the amount corresponding to the ejection amount. The sixth chamber is in fluid communication only with the fifth chamber through a porous material 103 except for the ejection outlet 105*a,* and therefore, the same amount of the ink is absorbed from the sixth chamber through the porous material 103 therebetween. Similarly, the ink is supplied sequentially from the adjacent chamber toward the air vent 104. In this manner, the ink is continuously supplied to the ejection outlet 105*a*. When there is no suppliable ink in the adjacent chamber the air vent 104, the air is supplied through the porous material 103 supplied from the air vent 104. In this manner, the ink is consumed from the chamber in order from the air vent 104 side. At this time, the porous material 103 between the chamber without ink closest to the ejection outlet 105*a* and the chamber adjacent thereto, involves a number of fine meniscuses, by which a predetermined negative pressure is maintained in the ink container.

The description will be made as to maintaining the state of the ink when the printing operation is not effected. With the change in the ambient condition and the change of the ambient temperature or pressure, the air significantly expands and contracts although the volume of the ink hardly changes. For example, in the case of FIG. 11A, when the temperature rises, the air in the first–fifth chambers can easily escape of the outside even if the expansion occurs and therefore does not apply the pressure to the recording head, because the porous material 103 therein hardly contains the ink and is in communication with the ambience through the air vent 104. However, the air in the fourth chamber is isolated from the ambience by the ink, and therefore, the ink in the fourth chamber is pushed out into the third chamber with the expansion of the air in the fourth chamber. However, the ink pushed out into the third chamber goes to expand toward the first chamber in the porous material 103, and therefore, during this process, the air in the third and second chambers is isolated from the ambience. As a result, as shown in FIG. 11B, the pushed-out air hardly enters the third and second chambers, and therefore moves only to the first chamber having the air vent 104.

Since it is only one chamber that the air is isolated from the ambience before the temperature rise, the amount of the ink to be taken into account is determined for each of the second and subsequent chambers at a predetermined ratio in view of the temperature and pressure variation to be expected.

Figure 11B:
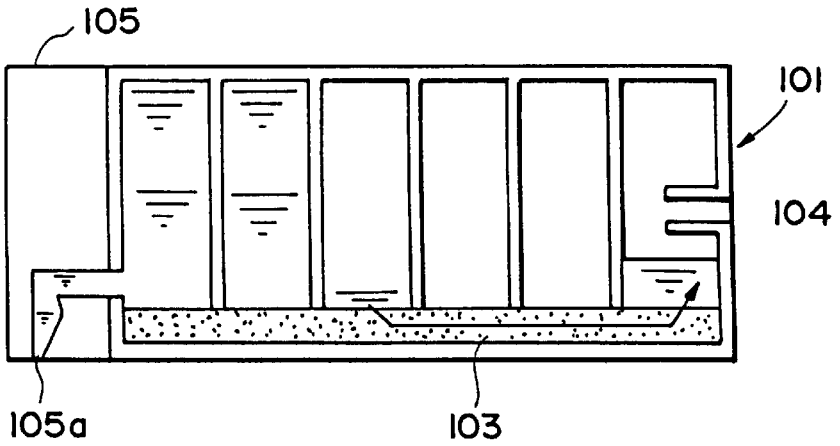
Figure 11C:
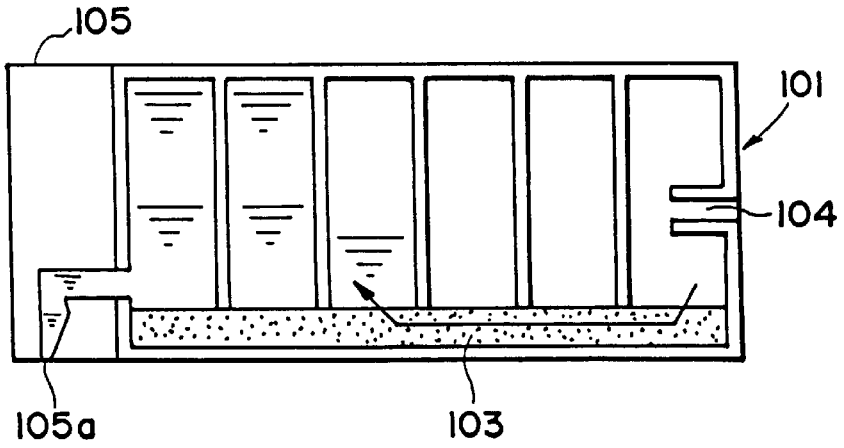

When the temperature decreases from the state shown in FIG. 11B, (the air in the second, third and fourth chambers is isolated from the ambience), the ink having moved to the first chamber by the contraction of the air is sucked back into the second, third and fourth chambers. Finally, the initial state is restored as shown in FIG. 11C.

The ink state maintaining function when the printing operation is not carried out, works in any other position or pose of the container. However, the function is slightly different only when it is upside down and therefore the ink is completely out of contact with the porous material 103. Even if the temperature rises, the ink does not overflow into the first chamber because all the air in the ink container is in fluid communication with the ambience. The produced negative pressure is maintained by the meniscus at the gas-liquid interface in the porous material, and the negative pressure or vacuum is maintained so that the ink can be stably supplied without leakage at least when the container takes the normal position or pose in the printer.

With the structure of the above-described ink container, the ink can be stably supplied irrespective of the temperature change or pressure change in the normal pose, and in addition, even if the ink moves between ink spaces due to the temperature or pressure change, the original state can be restored.

The inclination of the ink container which occurs during normal use is approx. 45 degrees. Depending on the types of the printers, it may be inclined by 90 degrees, in which the proper arrangement of the porous material can permit stabilized ink supply.

The ink consumption process and the negative pressure generation mechanism having been described in conjunction with FIGS. 9–11, apply to the embodiment of FIGS. 1 and 2.

As shown in FIGS. 1 and 2, the body 1 of the ink container of this embodiment has the similar structure and functions to the above-described conventional example except for the ink chamber 3 (supply chamber) closest to the recording head 2. The supply chamber 3 is provided with an ink supply port 4 at the lower position, which is in fluid communication with the ink ejection outlet. The ink chamber 3 has a horizontal cross-section having a shorter dimension in a direction in which the ink chamber is arranged, and therefore, the inner volume thereof is smaller than the other. The entirety or at least the supply chamber 3 of the container body 1 is made of substantially transparent material so as to permit detection of the ink quantity therein by eyes or photosensor. The cross-sectional area of the supply chamber 3 is approx. one fifth of the other ink chamber, and therefore, the degree of change of the ink level is 5 times that In the other chambers. On the basis of the dimensions of the conventional example, the dimension of the supply chamber 3 is 2 mm in the direction In which the chambers are arranged, by which the capacity is made one fifth. The lowering of the ink level per 1 page is 1.75 mm as contrasted to 0.35 mm in the conventional example. By this, the change of the ink amount can be correctly detected.

Embodiment 2

Figure 3:
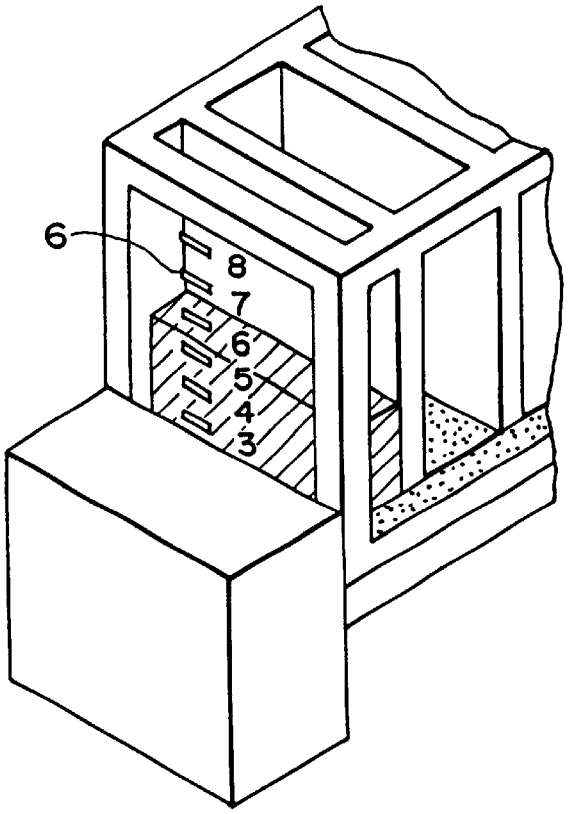
FIG. 3 shows a part of an ink cartridge according to an embodiment of the present invention.

Referring to FIG. 3, the second embodiment of the present invention will be described, in which the fundamental structure of the ink container is the same as that of FIGS. 1 and 2, and the same reference numerals as in FIGS. 1 and 2 are assigned to the elements having the corresponding functions, and the detailed description thereof are omitted for simplicity.

On the outside wall of the supply chamber 3 of the ink container shown in FIG. 3 is provided with a scale 6 for observation, wherein the figures indicate approximate printable numbers of sheet. The outer wall having the scale in the supply chamber 3 is provided with a transparent member. Thus, the amount of the ink in the ink chamber closest to the recording head is observable with the scale 6, so that the remaining amount of the ink can be recognized by the user who will be notified with the coming necessity for the replacement of the ink cartridge. Since the horizontal cross-sectional area of the supply chamber 3 of the ink cartridge is smaller than the other ink chambers, the variation of the liquid level in the chamber is large, thus providing more correct ink quantity change, thus permitting ink cartridge replacement at the proper timing.

Embodiment 3

Figure 4A:
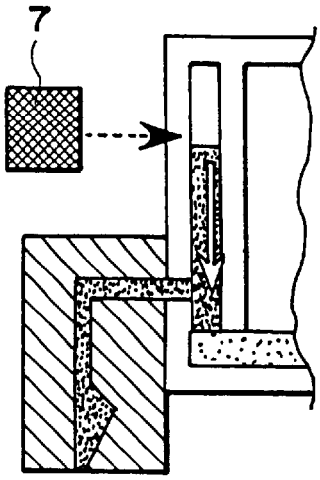
FIGS. 4A, 4B and 5 are schematic sectional views of an ink cartridge structure according to an embodiment of the present invention.

Referring to FIG. 4A, a third embodiment of the present invention will be described, in which the fundamental structure of the ink cartridge is the same as in the first and second embodiments.

In FIG. 4A. a reflection type photosensor 7 is disposed adjacent the supply chamber 3 to detect the liquid level in the supply chamber 3. Depending on the existence or non-existence of the ink in the supply chamber 3, the degree of transmission of the external light is different, and depending on the light transmitted or reflected is received by a photosensor. In response to the quantity of the light received, discriminating means such as an unshown microcomputer can recognize the lowering of the ink level. The printable number of sheets corresponding to different positions of the ink levels are stored beforehand in a microcomputer, and when the quantity of the light received by the photosensor changes (from small to large), the passage of the ink level by the sensor is recognized, and notifies the remaining number of printable sheets to the user.

Figure 12:
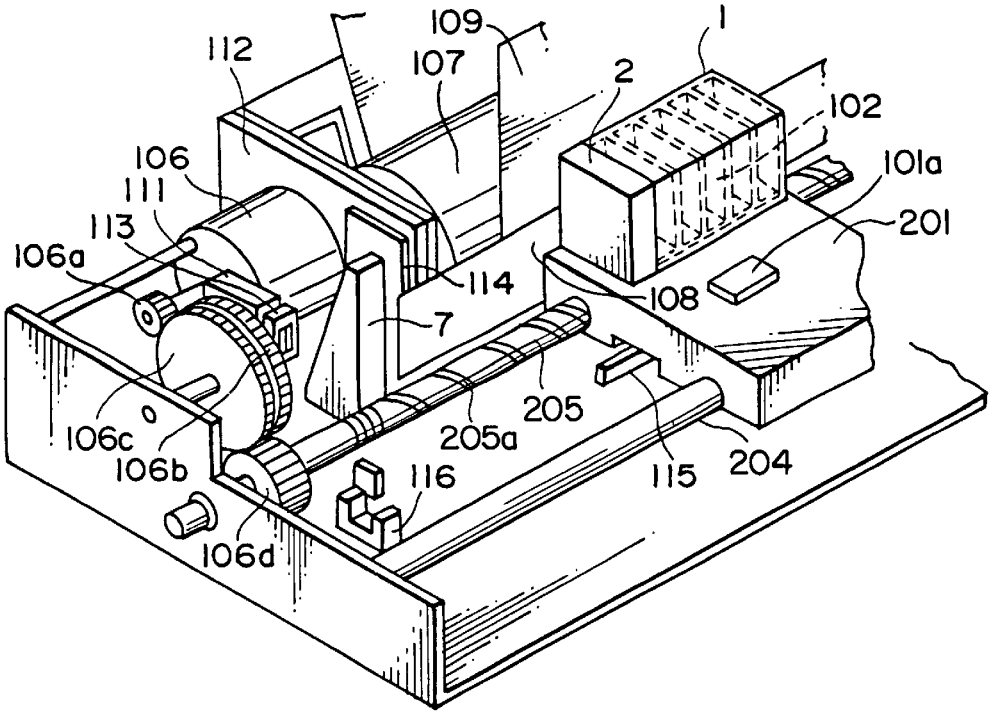
FIG. 12 is perspective view of an ink jet printer according to an embodiment of the present invention.

Referring to FIG. 12, the description will be made as to a recording apparatus capable of properly detecting ink remaining quantity in an ink container, according to an embodiment of the present invention.

The recording head 2 may be an ink jet head which discharges ink by the use of heat energy, which is preferably a head comprising heat energy generating elements for generating the heat energy supplied to the ink, thereby changing the state of the ink and discharging the ink through ejection ports. Drive signals for recording are applied to the heat energy generating elements of the recording head 2 from drive signal supply circuitry 101*a*.

A recording head 2 and an ink container 102 according to any one of the above examples are joined so as to constitute a recording head unit. The recording head unit is carried on a carriage 201 guided by a guiding shaft 204 and a lead screw 205 having a helical groove 205*a*. In an alternative arrangement, the ink container may be mountable to the recording head.

The lead screw 205 is rotated in the forward and backward directions by a reversible motor 106 through gears 106*a*, 106*b*, 106*c* and 106*d*. The carriage 201 is reciprocated in the direction indicated by an arrow and in the opposite direction through an unshown pin on the cartridge 201 being in engagement with the helical groove 205*a*. Switching between forward and backward rotation of the driving motor 106 is effected in response to arrival of the carriage at a home position, which is detected by a combination of a lever 115 on the carriage 201 and a photocoupler 116 on the apparatus body.

Recording material in the form of a sheet of paper 109 is contacted to a platen 107 by a confining plate 108. The shaft faces the recording head 2 and is advanced by an unshown sheet feeding roller driven by a sheet feeding motor (not shown).

A recovery unit 111 functions to remove foreign matter or increased-viscosity ink in the ejection port of the recording head 2 so as to recover the regular ejection performance. The recovery unit 111 comprises a capping member 113 in communication with an unshown suction pump that draws ink through the ejection ports of the recording head 2 when the capping member is in place to remove foreign matter and increased-viscosity ink from the ejection ports. Between the recovery unit 111 and the platen 107, there is provided a cleaning blade 114 which is movable toward and away from the recording head 2 along a guiding member 112. A free end of the cleaning blade 114 is effective to remove foreign matter and ink droplets deposited on the ejection port surface of the recording head.

The ink container 102 has the above-mentioned plural chambers communicating with each other only through a continuous porous material and the ink container is made of transparent polypropylene.

During printing, the carriage 201 having the recording head 2 and the ink container 102 is reciprocated in both directions by rotation of the lead screw 105 in the forward and backward directions. During a non-printing time period, the carriage 201 is moved and positioned where the capping member 113 covers the ejection ports of the recording head 2.

As a sensor for detecting the ink remaining amount, a photosensor 7 is provided adjacent a home position of the carriage 201. The photosensor is faced to the ink container 102, and detects whether the liquid level in the supply chamber 3 of the ink container 102 is higher or lower than a predetermined level. The position of the photosensor 7 is preferably such that it is faced to the supply chamber 3 at the position where the carriage 201 stops. This is because, the ink level surface moves with the motion of the carriage 201.

Together with a recovery operation for the recording head 2 using a capping member 113, the remaining amount of the ink can be detected, thus preventing the reduction of the throughput.

The point of the ink detection by the photosensor 7 is not limited only to the supply chamber 3, but the detection may be effected for another chamber or chambers. By doing so, the remaining amount of the ink can be detected quite before the ink empty. In FIG. 12, only one photosensor is used, and therefore, one photosensor 7 functions to detect a plurality of ink chambers. To accomplish this, the carriage 201 is controlled to move such that the respective ink chambers of the ink container 102 are faced to the recording head 2 sequentially. With this structure, one photosensor is enough to detect the plurality of ink chambers.

Figure 13:
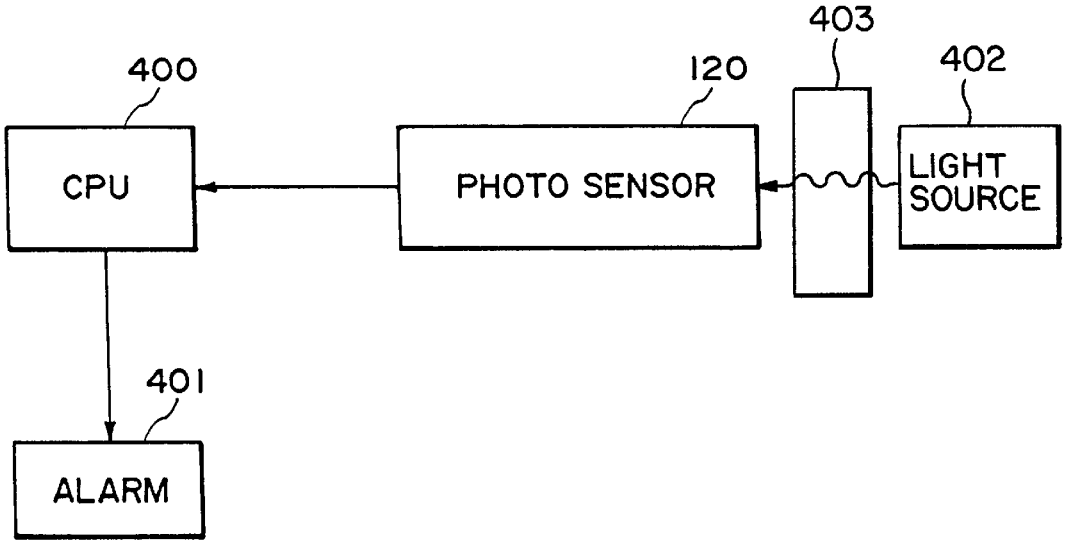
FIG. 13 is a schematic block diagram showing a device for detecting a decrease in the amount of ink according to the present invention.

FIG. 13 is a schematic block diagram showing a device for detecting a decrease in the amount of ink according to this invention. In FIG. 13, reference numeral 120 denotes a photosensor, and after "photosensor" add which receives light from a light source 402 transmitted through the light-transmissible portion 403 of the ink container 102, reference numeral 400 denotes a CPU (central processing unit), which constitutes judging means, and reference numeral 401 denotes alarm means. The CPU 400 judges whether or not the ink amount is sufficient based on a signal output from the photosensor 7.

When the CPU detects that the reduction of the remaining amount of the ink is detected by the photosensor 7, alarming means 401 is operated.

Figure 14:
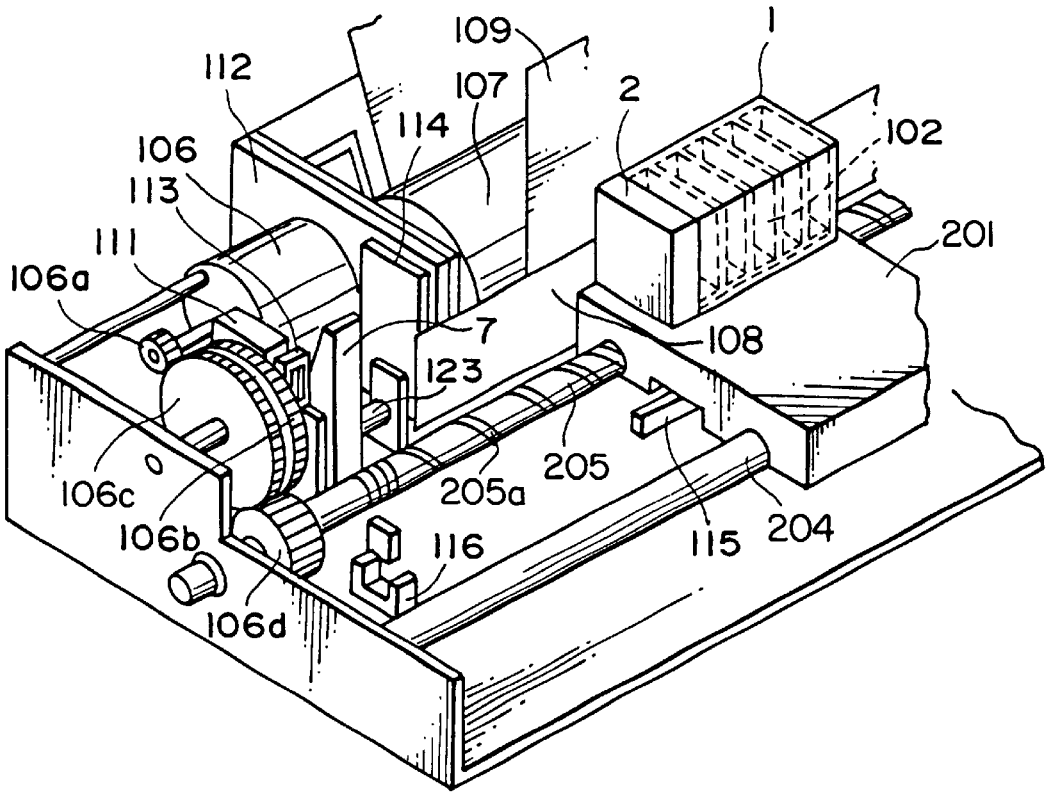
FIG. 14 is a perspective view of an ink jet printer according to an embodiment of the present invention.

In the foregoing, as the structure for detecting the remaining state in the ink chamber, the remaining amount of the ink chamber faced to the photosensor 7 is detected while the carriage 201 is being moved, in the above-described structure. In another alternative, the photosensor 7 may be movable as shown in FIG. 14.

As described in the foregoing, the reduction of the remaining amount of the ink in the supply chamber 3 can be accurately detected by the photosensor 7.

In this embodiment, the photosensor 7 may be provided on the carriage.

Figure 4B:
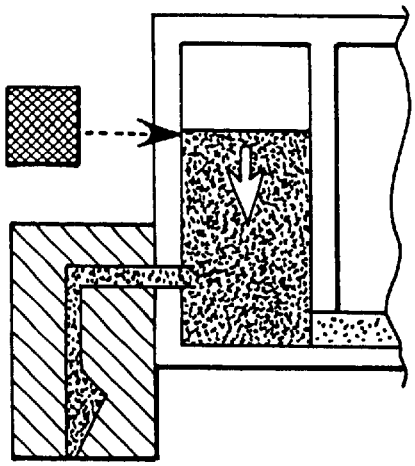

As described above, the change of the liquid level in the supply chamber 3 relative to the reduction of the ink quantity is large, and therefore, more accurate ink quantity detection is possible as contrasted to the conventional ink container shown in FIG. 4B.

By selecting the horizontal cross-sectional area of the supplying chamber, the error of the remaining amount detection can be made not more than 1 page.

In the foregoing embodiments, external light is directed to the transparent wall, the change of the reflected light is detected to detect the remaining amount of the ink in the supply chamber 3. However, transmitted light in place of the reflected light may be detected.

The output difference depending on the existence or non-existence of the ink is larger in the transparent type sensor than in the reflection type sensor. Therefore, the transparent type sensor is preferable to detect the ink level change more accurately.

Figure 5:
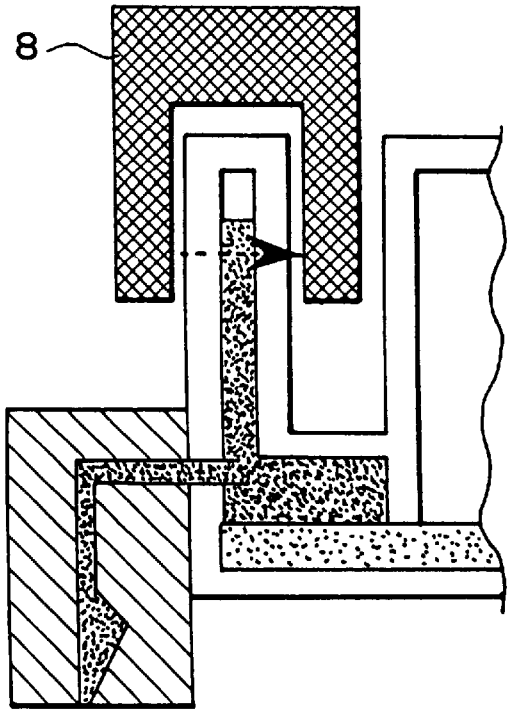

FIG. 5 shows an embodiment in which the supply chamber 3 is in the form of an ink container independent from the other ink chamber to permit use of higher accuracy transparent type photosensor 8.

Figure 6:
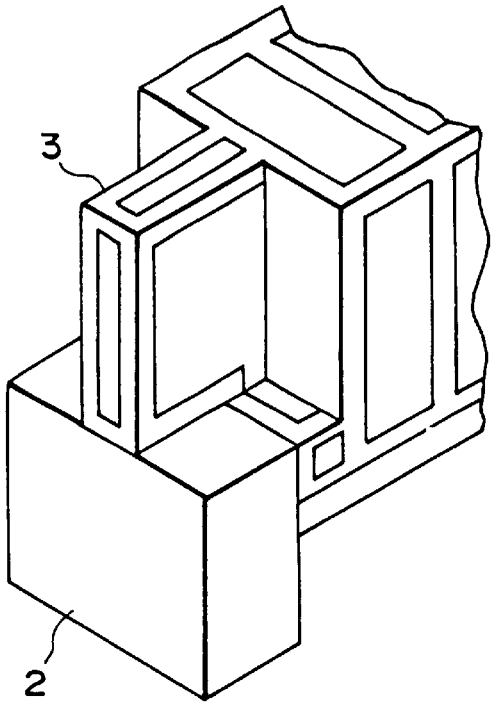
FIG. 6 is a schematic perspective view of an ink cartridge according to an embodiment of the present invention.

FIG. 6 shows an embodiment in which a width dimension of a horizontal cross-section of the supply chamber is reduced, the inner volume is reduced, to permit use of the transparent type sensor as in FIG. 5 embodiment.

In the foregoing embodiments, the change of the ink level in the supply chamber 3 of the ink cartridge is detected by a photosensor. The present invention is not limited to this structure, but it is a possible alternative that at least one pair of electrodes is disposed in the supply chamber 3, and the electric conductance between the electrodes are detected to detect the reduction of the remaining amount of the ink in the liquid chamber 3.

Figure 7A:
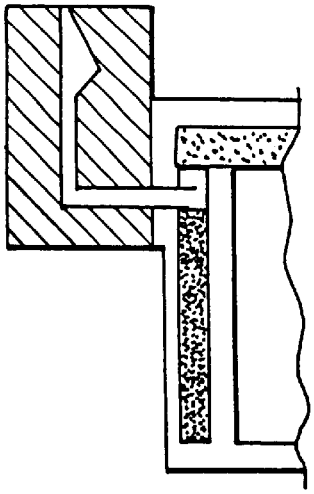
FIGS. 7A and 7B are schematic views; of an ink cartridge taking an upside down position or pose.
Figure 7B:
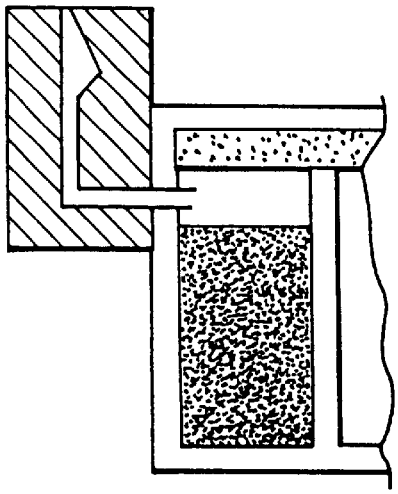

A wasteful amount of the ink is one fifth the amount in the conventional example, even if the ink container is placed upside down as shown in FIG. 7 during consumption of the ink in the supply chamber 3 and kept for a certain period with this state, and the ink dries at the outlet of the ink with the result of incapability of the cartridge.

Figure 8:
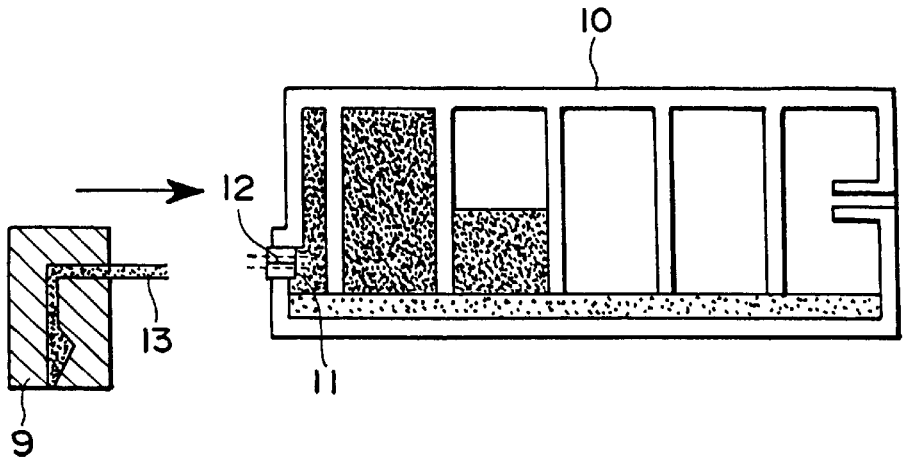
FIG. 8 is a schematic sectional view of an ink cartridge according to an embodiment of the present invention.

FIG. 8 is a schematic sectional view of a detachably mountable cartridge comprising a recording head and the container body 10. The ink supply port 11 of the container body 10 is sealed by a rubber plug 12. The rubber plug 12 is cylindrical, and is provided with an opening at the center. When it is mounted to the container body 10, it is cramped by the frame so that the opening is closed. When it is to be connected with a recording head 9, the pipe 13 of the recording head 9 penetrates the rubber plug 12 to establish ink communication.

With this structure, the leakage of the ink from the container before being mounted to the recording head, can be prevented.

In the embodiments described hereinbefore, the inner volume of the supply chamber 3 is one fifth that of the other chamber. The detection accuracy of the ink remaining amount is increased with the decrease of the horizontal cross-sectional area. However, the supply chamber is preferably capable of containing the amount of ink enough to print 5 or more sheets in consideration of the case in which the printing duty is high with larger ink consumption as in image printing or the case in which a large number of sheets are continuously printed.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore. the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition. the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

The ink jet recording apparatus may be used as an output terminal of an information processing apparatus such as computer or the like, as a copying apparatus combined with an image reader or the like, or as a facsimile machine having information sending and receiving functions.

As described in the foregoing, according to the present invention, the reduction of the remaining amount of the ink can be accurately detected.

Additionally, the remaining amount of the ink can be substantially correctly detected immediately before the container is emptied, and therefore, the ink container replacement timing can be properly recognized. Furthermore, even if the ink container is placed and kept upside down, the amount of the ink which is not usable can be reduced.

While the invention has been described with reference to the structures disclosed herein, it is not confined to the details set forth and this application is intended to cover such modifications or changes as may come within the purposes of the improvements or the scope of the following claims.

What is claimed is:

1. An ink container comprising:

at least one partition dividing said ink container into plural ink chambers including at least a first ink chamber and a second ink chamber, said partition defining an ink path connecting said plural ink chambers in series;

an air vent for communicating said first ink chamber with atmosphere; and an ink supply port for supplying ink from said second ink chamber to outside;

wherein said ink path includes an ink absorbing material and provides for an ink flow to said ink supply port that empties each of said plural ink chambers in said series sequentially as ink is supplied from said ink supply port, wherein said second chamber has a space that directly contains the ink and further has a wall, at least a portion of the wall comprising a light-transmissible material, and wherein said second ink chamber has a horizontally extending cross-sectional area which in use is smaller than that of at least one other of said plural ink chambers so that a change in an ink level in said second ink chamber due to consumption of the ink is greater than that in said one other chamber.

2. An ink container according to claim 1, wherein the portion of the wall comprising a light-transmissible material is provided with a scale by which a visual observation of an amount of ink remaining in said second ink chamber can be made.

3. An ink container according to claim 1, wherein said ink absorbing material is continuous.

4. An ink container according to claim 1, further comprising a wall adjacent said ink path, wherein said ink absorbing material extends along at least said wall and is adjacent to said partition, thereby separating said wall of said ink container from said partition.

5. An ink container according to claim 1, wherein all of said plural ink chambers are arranged side-by-side to form an assembly having two ends, with said first ink chamber at one end of said assembly and said second ink chamber at the other end of said assembly.

6. A recording head assembly comprising an ink container according to claim 1 and a recording head mounted to said ink container, said recording head having ink communication means for receiving ink from said ink supply port, and ink ejection means for ejecting ink received from said supply port.

7. A recording head assembly according to claim 6, wherein said recording head is detachably mountable to said ink container.

8. A recording head assembly according to claim 6, wherein said ink ejection means has thermal energy convertors for generating thermal energy for use in ejecting ink.

9. An ink container according to claim 1, wherein said horizontally extending cross-sectional area extends horizontally in a direction through both of said second chamber and said one other chamber.

10. An ink container according to claim 1, wherein said second ink chamber constituting an ink reservoir is substantially free of ink absorbing material.

11. An ink jet recording apparatus for effecting recording on a recording material using ink ejection means for ejecting ink from a recording head, the apparatus comprising:

an ink container for supplying ink to the recording head and having at least one partition dividing said ink container into plural ink chambers including at least a first ink chamber and a second ink chamber, said partition defining an ink path connecting said plural ink chambers in series;

an air vent for communicating said first ink chamber with atmosphere;

an ink supply port for supplying ink from said second ink chamber to said recording head;

scanning means for scanningly moving the recording head relative to the recording material;

driving means for driving the ink ejection means of said recording head, and detecting means for detecting whether a remaining amount of ink in said second ink chamber is smaller than a predetermined amount;

wherein said ink path includes an ink absorbing material and provides for an ink flow to said ink supply port that empties each of said plural ink chambers in said series sequentially as ink is supplied from said ink supply port, wherein said second chamber has a space that directly contains the ink and further has a wall, at least a portion of the wall comprising a light-transmissible material, and wherein said second ink chamber has a horizontally extending cross-sectional area which in use is smaller than that of at least one other of said plural ink chambers so that a change in an ink level in said second ink chamber due to consumption of ink is greater than that in said one other chamber.

12. An apparatus according to claim 11, wherein the portion of the wall comprising a light-transmissible material is provided with a scale by which a visual observation of an amount of ink remaining in said second ink chamber can be made.

13. An apparatus according to claim 11, wherein said ink absorbing material is continuous.

14. An apparatus according to claim 11, further comprising a wall adjacent said ink path, wherein said ink absorbing material extends along at least said wall and is adjacent to said partition, thereby separating said wall of said ink container from said partition.

15. An apparatus according to claim 11, wherein the ink ejection means includes thermal energy convertors for generating thermal energy for use in ejecting ink.

16. An ink jet recording apparatus according to claim 11, wherein said detecting means comprises light emitting means for emitting light to the light-transmissible material and receiving means for receiving the light.

17. An apparatus according to claim 16, wherein said receiving means receives light reflected by the light-transmissible material and by a portion of an inside surface of said second ink chamber.

18. An apparatus according to claim 16, wherein said receiving means receives the light transmitted through the light transmissible material.

19. An apparatus according to claim 16, further comprising means for notifying an output of said detecting means.

20. An apparatus according to claim 11, wherein said ink container is integral with said recording head.

21. An apparatus according to claim 11, wherein said recording head is detachably mountable to said ink container.

22. An apparatus according to claim 11, wherein said horizontally extending cross-sectional area extends horizontally in a direction through both of said second chamber and said one other chamber.

23. An ink jet recording apparatus according to claim 11, said second ink chamber constituting an ink reservoir is substantially free of ink absorbing material.

* * * * *

UNITED STATES PATENT AND TRADEMARK OFFICE

CERTIFICATE OF CORRECTION

PATENT NO. : 6,296,354 B1
DATED : October 2, 2001
INVENTOR(S) : Kenichirou Hashimoto It is certified that error appears in the above-identified patent and that said Letters Patent is hereby corrected as shown below:

Title page,
Item [57], ABSTRACT,
Line 3, "the" should be deleted;
Line 6, "the" (second occurrence) should be deleted;
Line 7, "the" (second occurrence) should be deleted; and
Line 9, "wherein" should read -- and wherein --.

Drawings,
Figure 13, "PHOTO SENSOR" should read -- PHOTOSENSOR --.

Column 1,
Line 21, "a" should read -- an --; and
Line 25, "are" should read -- is --.

Column 2,
Line 7, "up," should read -- up, and --; and
Line 31, "With" should read -- with --.

Column 3,
Line 22, "As an" should read -- An --;
Line 29, "ink" (first occurrence) should read -- in --;
Line 30, "ink" should read -- ink. --;
Line 44, "leaks" should read -- leak --;
Line 48, "FIG. 11," should read -- FIGS. 11A-11C, --; and
Line 52, "supplied" should read -- supply --.

Column 4,
Line 4, "approx." should read -- approximately --;
Line 6, "10" should read -- 10mm --;
Line 14, "±3 page." should read -- ±3 pages. --;
Line 17, "short" should read -- shortage --; and
Line 46, "wherein" should read -- and wherein --.

UNITED STATES PATENT AND TRADEMARK OFFICE

CERTIFICATE OF CORRECTION

PATENT NO. : 6,296,354 B1
DATED : October 2, 2001
INVENTOR(S) : Kenichirou Hashimoto It is certified that error appears in the above-identified patent and that said Letters Patent is hereby corrected as shown below:

Column 5,
Line 1, "views;" should read -- views --;
Line 9, "FIGS. 11a-11c" should read -- FIGS. 11A-11C --;
Line 34, "to eject the ink" should be deleted;
Line 41, "are" should read -- is --;
Line 48, "with;" should read -- with --;
Line 56, "the" should be deleted; and
Line 65, "chamber" should read -- chamber toward --.

Column 6,
Line 13, "of" should read -- to --; and
Line 28, "is" (first occurrence) should read -- is in --.

Column 7,
Line 15, "In" should read -- in --;
Line 18, "In" should read -- in --;
Line 29, "description" should read -- descriptions --; and
Line 51,"FIG. 4A." should read -- FIG. 4A, --.

Column 8,
Line 22, "cartridge 201" should read -- carriage 201 --; and
Line 54, "screw 105" should read -- screw 205 --.

Column 9,
Line 18, "photosensor, and after "photosensor" add" should read -- photosensor --;
Line 25, "photosensor 7." should read -- photosensor 120. --; and
Line 27, "photosensor 7," should read -- photosensor 120, --.

Column 11,
Line 39, "recording head mountable," should read -- mountable recording head, --.

UNITED STATES PATENT AND TRADEMARK OFFICE

CERTIFICATE OF CORRECTION

PATENT NO. : 6,296,354 B1
DATED : October 2, 2001
INVENTOR(S) : Kenichirou Hashimoto It is certified that error appears in the above-identified patent and that said Letters Patent is hereby corrected as shown below:

Column 14,
Line 33 "said" should read -- wherein said --.

Signed and Sealed this

Twenty-third Day of July, 2002

*Attest:*

*Attesting Officer*

JAMES E. ROGAN
*Director of the United States Patent and Trademark Office*